US009764200B2

(12) United States Patent
Watanabe et al.

(10) Patent No.: US 9,764,200 B2
(45) Date of Patent: Sep. 19, 2017

(54) MULTI-PIECE SOLID GOLF BALL

(71) Applicant: Bridgestone Sports Co., Ltd., Tokyo (JP)

(72) Inventors: Hideo Watanabe, Chichibushi (JP); Akira Kimura, Chichibushi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 30 days.

(21) Appl. No.: 14/924,000

(22) Filed: Oct. 27, 2015

(65) Prior Publication Data

US 2016/0175661 A1 Jun. 23, 2016

(30) Foreign Application Priority Data

Dec. 19, 2014 (JP) ..... 2014-257439

(51) Int. Cl.
*A63B 37/04* (2006.01)
*A63B 37/06* (2006.01)
*A63B 37/00* (2006.01)

(52) U.S. Cl.
CPC ..... *A63B 37/0092* (2013.01); *A63B 37/0063* (2013.01); *A63B 37/0068* (2013.01); *A63B 37/0076* (2013.01); *A63B 37/0084* (2013.01); *A63B 37/0033* (2013.01); *A63B 37/0045* (2013.01)

(58) Field of Classification Search
USPC ..... 473/351–378
See application file for complete search history.

(56) References Cited

U.S. PATENT DOCUMENTS

| | | | | |
|---|---|---|---|---|
| 6,692,379 | B2 * | 2/2004 | Morgan | A63B 37/0003 473/370 |
| 6,923,735 | B1 * | 8/2005 | Hayashi | A63B 37/0003 473/376 |
| 6,966,849 | B2 * | 11/2005 | Kato | A63B 37/0003 473/376 |
| 7,294,068 | B2 * | 11/2007 | Higuchi | A63B 37/0043 473/376 |
| 7,335,115 | B1 * | 2/2008 | Watanabe | A63B 37/0076 473/376 |
| 8,764,584 | B2 * | 7/2014 | Watanabe | A63B 37/0076 473/376 |
| 2007/0281801 | A1 | 12/2007 | Watanabe et al. | |
| 2007/0281802 | A1 | 12/2007 | Watanabe et al. | |
| 2007/0287557 | A1 | 12/2007 | Watanabe et al. | |
| 2008/0064526 | A1 | 3/2008 | Watanabe et al. | |
| 2009/0111610 | A1 | 4/2009 | Watanabe et al. | |

* cited by examiner

*Primary Examiner* — Alvin Hunter
(74) *Attorney, Agent, or Firm* — Sughrue Mion, PLLC

(57) ABSTRACT

Multi-piece solid golf ball having a core, an envelope layer encasing the core, an intermediate layer encasing the envelope layer, and an outermost layer encasing the intermediate layer, the envelope layer-encased sphere, the intermediate layer-encased sphere and the ball have surface hardnesses which satisfy a specific relationship, the intermediate layer and the cover have thicknesses which satisfy a specific relationship, and the core has a hardness profile in which the hardnesses at the core surface, core center, a position 5 mm from the core center, and a position midway between the core surface and center satisfy specific relationships.

7 Claims, 1 Drawing Sheet

MULTI-PIECE SOLID GOLF BALL

CROSS-REFERENCE TO RELATED APPLICATION

This non-provisional application claims priority under 35 U.S.C. §119(a) on Patent Application No. 2014-257439 filed in Japan on Dec. 19, 2014, the entire contents of which are hereby incorporated by reference.

BACKGROUND OF THE INVENTION

Field of the Invention

The present invention relates to a multi-piece solid golf ball of four or more pieces which has a core, an envelope layer, an intermediate layer and a cover (outermost layer). The invention relates in particular to a multi-piece solid golf ball which is competitively advantageous when used by professional golfers and skilled amateurs.

Prior Art

Numerous golf balls have hitherto been developed as golf balls for professional golfers and skilled amateurs. Of these, multi-piece solid golf balls having an optimized hardness relationship among the different layers encasing the core, such as the intermediate layer and the cover (outermost layer), are in widespread use because they achieve both a superior distance performance in the high head-speed range and also good controllability on shots with an iron and on approach shots. Recently, to achieve even better performance such as flight, many four-piece solid golf balls have been described in which an envelope layer is additionally provided between the core and the intermediate layer, thereby giving a ball structure having four layers. Technical literature on such four-piece solid golf balls includes the following published art.

U.S. Published Patent Application No. 2007/0281801 discloses a golf ball in which a urethane material is used as the cover, the hardnesses and thicknesses of the individual layers are adjusted within specific ranges, and the core diameter is made somewhat large. U.S. Published Patent Application No. 2007/0287557 discloses a golf ball in which a highly neutralized resin material is used as the envelope layer material and the ball has been given a structure that is hard on the inside and soft on the outside. U.S. Published Patent Application 2008/0064526 describes a golf ball in which the core hardness profile and the hardnesses of the individual layers have been designed in specific ranges, and a urethane material is used as the cover. U.S. Published Patent Application 2007/0281802 teaches a golf ball in which the core hardness profile is designed in a specific range, a highly neutralized resin material is used as the envelope layer material, and the cover is made relatively soft. U.S. Published Patent Application 2009/0111610 describes a golf ball in which the hardnesses and thicknesses of the individual layers are designed in specific ranges, a highly neutralized resin material is used as the envelope layer material, and a urethane material is used as the cover.

However, with some of these golf balls, although professional golfers and skilled amateurs are able to satisfactorily extend the carry on shots with a driver (W#1), they are unable to achieve a sufficiently high spin performance on approach shots using a wedge. Conversely, there are golf balls which, while capable of maintaining a sufficient spin performance on approach shots, have an insufficient spin rate-lowering effect on shots with a driver (W#1) or an inadequate ability to maintain a straight trajectory on full shots, as a result of which there remains room for improvement in the distance traveled by the ball. Accordingly, there exists a desire for the development of a golf ball which achieves both an excellent distance performance and also an excellent spin performance on approach shots when used in a relatively high head-speed range such as by professional golfers and skilled amateurs.

It is therefore an object of the invention to provide a golf ball which is capable of satisfying at a high level both the flight and control performances desired for use by professional golfers and skilled amateurs.

SUMMARY OF THE INVENTION

As a result of extensive investigations, we have discovered that, in a multi-piece solid golf ball having a core, an envelope layer, an intermediate layer and a cover (outermost layer), by having the cover be hard on the inside and soft on the outside (i.e., having the intermediate layer be harder than the cover) and making the intermediate layer somewhat hard, by adjusting the relationship among the initial velocities of the respective layers and the relative thicknesses of the intermediate layer and the cover within specific ranges, and moreover by forming the core, the envelope layer, the intermediate layer and the cover as successive layers while also focusing on the detailed hardness profile at the core interior, it is possible to provide a golf ball which is able to satisfy at a very high level the flight and control performances in a relatively high head speed range such as that of professional golfers and skilled amateurs, and which in particular holds down the spin rate and maintains a straight trajectory on full shots with a driver (W#1), thus exhibiting a superior flight performance. That is, by developing the golf ball in such a way as to give the ball a three-layer cover structure wherein the envelope layer, the intermediate layer and the cover (outermost layer) encasing the core have hardnesses which are, from the outside, soft/hard/soft, to provide a core made of a rubber composition with a hardness profile that further reduces the spin rate on full shots—specifically by, in core hardness profile and hardness slope design, conferring the center portion of the core with a flat or relatively gentle hardness gradient and making the overall gradient larger than the degree of gradient at the core interior—and to give the ball interior a high resilience, and thus designing the ball with an overall construction of four or more layers, it was possible to fully achieve both an excellent distance performance in the relatively high head speed range of professional golfers and skilled amateurs and also an excellent spin performance on approach shots. In addition to achieving both the above flight performance and the above spin performance on approach shots, the golf ball of the invention also has an excellent scuff resistance and thus is capable of fully enduring even harsh conditions of use.

The head speed range of professional golfers and skilled amateurs is very high, and refers more precisely to head speeds (HS) of generally from 42 to 55 m/s. Within this range, the head speed range for skilled amateur golfers corresponds to 42 to 50 m/s, and the head speed range for professional golfers corresponds to 45 to 55 m/s.

Accordingly, the invention provides a multi-piece solid golf ball having a core, an envelope layer encasing the core, an intermediate layer encasing the envelope layer, and an outermost layer encasing the intermediate layer, wherein the sphere obtained by peripherally encasing the core with the envelope layer (envelope layer-encased sphere), the sphere obtained by peripherally encasing the envelope layer with the intermediate layer (intermediate layer-encased sphere), and the ball have respective surface hardnesses, expressed in terms of Shore D hardness, which satisfy the relationship ball surface hardness<surface hardness of intermediate layer-encased sphere>surface hardness of envelope layer-encased sphere;

the intermediate layer and the cover have respective thicknesses which satisfy the relationship cover thickness<intermediate layer thickness;

the core, the envelope layer-encased sphere, the intermediate layer-encased sphere and the ball have respective initial velocities which satisfy the relationship ball initial velocity<initial velocity of intermediate layer-encased sphere>initial velocity of envelope layer-encased sphere>core initial velocity; and the core has a hardness profile which, expressed in terms of JIS-C hardness, satisfies the following relationships:

22≤core surface hardness(Cs)−core center hardness (Cc),

7≤[hardness at a position 5 mm from core center (C5)−core center hardness(Cc)]>0, and

[core surface hardness(Cs)−core center hardness (Cc)]/[hardness at a position midway between core surface and core center(Cm)−core center hardness(Cc)]≤3.

In a preferred embodiment of the golf ball of the invention, the [hardness at a position midway between core surface and core center (Cm)−core center hardness (Cc)] value, expressed in terms of JIS-C hardness, is 10 or less.

In another preferred embodiment of the inventive golf ball, the [hardness at a position 5 mm from core center (C5)−core center hardness (Cc)] value, expressed in terms of JIS-C hardness, is 5 or less.

In yet another preferred embodiment of the golf ball of the invention, the [core surface hardness (Cs)−core center hardness (Cc)]/[hardness at a position 5 mm from core center (C5)−core center hardness (Cc)] value, expressed in terms of JIS-C hardness, is 4 or more.

In still another preferred embodiment of the inventive golf ball, the initial velocity of the intermediate layer-encased sphere is larger than the core initial velocity.

In a further preferred embodiment of the golf ball of the invention, the (core surface hardness−ball surface hardness) value, expressed in terms of Shore D hardness, is in the range of from −3 to 3.

In a still further embodiment of the inventive golf ball, the initial velocities of the core, the intermediate layer-encased sphere and the ball satisfy the relationships:

(ball initial velocity−core initial velocity)≥−1.0 m/s; and (ball initial velocity−initial velocity of envelope layer-encased sphere)≥1.0 m/s.

The golf ball of the invention satisfies to a high level the flight and control performances desired for use by professional golfers and skilled amateurs, and moreover holds down the spin rate on full shots and follows a straight trajectory. In addition, this ball has an excellent scuff resistance and is thus capable of fully enduring harsh conditions of use.

DESCRIPTION OF THE DIAGRAMS

DETAILED DESCRIPTION OF THE INVENTION

The objects, features and advantages of the invention will become more apparent from the following detailed description, taken in conjunction with the foregoing diagrams.

Figure 1:
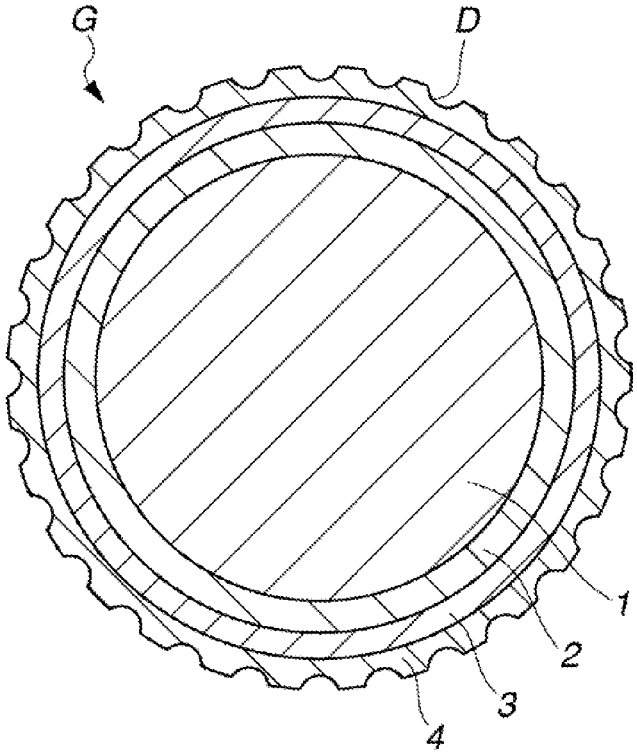
FIG. 1 is a schematic cross-sectional diagram showing an example of a golf ball structure according to the invention.

The multi-piece solid golf ball of the invention has, arranged in order from the inside of the golf ball: a core, an envelope layer, an intermediate layer and a cover (outermost layer). Referring to FIG. 1, a golf ball G has a core 1, an envelope layer 2 encasing the core 1, an intermediate layer 3 encasing the envelope layer 2, and a cover (outermost layer) 4 encasing the intermediate layer 3. The parts of the ball other than the core, these being the envelope layer, intermediate layer and cover (outermost layer), each have at least one layer, but are not limited to a single layer, and may be formed as a plurality of two or more layers. Numerous dimples D are generally formed on the surface of the cover 4 in order to enhance the aerodynamic properties of the ball. These layers are described in detail below.

The core may be formed using a known rubber composition. Although not particularly limited, preferred examples include rubber compositions formulated as described below.

The material forming the core may be one composed primarily of a rubber material. For example, the core may be formed using a rubber composition which includes, together with a base rubber, such ingredients as a co-crosslinking agent, an organic peroxide, an inert filler, sulfur, an antioxidant and an organosulfur compound.

In the practice of this invention, it is especially preferable to use a rubber composition containing compounding ingredients (I) to (III) below:

(I) a base rubber;

(II) an organic peroxide; and (III) water and/or a metal monocarboxylate.

The base rubber serving as component (I) is not particularly limited, although the use of a polybutadiene is especially preferred.

This polybutadiene may be one having a cis-1,4 bond content on the polymer chain of at least 60%, preferably at least 80 wt %, more preferably at least 90 wt %, and most preferably at least 95 wt %. When the content of cis-1,4 bonds among the bonds on the polybutadiene molecule is too low, the resilience may decrease.

A polybutadiene rubber differing from the above polybutadiene may also be included in the base rubber. In addition, styrene-butadiene rubber (SBR), natural rubber, polyisoprene rubber, ethylene-propylene-diene rubber (EPDM) or the like may be included as well. These may be used singly, or two or more may be used in combination.

The organic peroxide (II) is not particularly limited, although the use of an organic peroxide having a one-minute half-life temperature of from 110 to 185° C. is preferred. One, two or more organic peroxides may be used. The amount of organic peroxide included per 100 parts by weight of the base rubber is preferably at least 0.1 part by weight, and more preferably at least 0.3 part by weight. The upper limit is preferably not more than 5 parts by weight, more preferably not more than 4 parts by weight, and even more preferably not more than 3 parts by weight. A commercially available product may be used as the organic peroxide. Specific examples include those available under the trade names Percumyl D, Perhexa C-40, Niper BW and Peroyl L (all from NOF Corporation), and Luperco 231XL (from Atochem Co.).

The water serving as component (III) is not particularly limited, and may be distilled water or tap water. The use of distilled water which is free of impurities is especially preferred. The amount of water included per 100 parts by weight of the base rubber is preferably at least 0.1 part by weight, and more preferably at least 0.3 part by weight. The upper limit is preferably not more than 5 parts by weight, more preferably not more than 4 parts by weight, and even more preferably not more than 3 parts by weight.

By including a suitable amount of such water, the moisture content in the rubber composition before vulcanization becomes preferably at least 1,000 ppm, and more preferably at least 1,500 ppm. The upper limit is preferably not more than 8,500 ppm, and more preferably not more than 8,000 ppm. When the water content of the rubber composition is too low, it may be difficult to obtain a suitable crosslink density and tan δ, which may make it difficult to mold a golf ball having little energy loss and a reduced spin rate. On the other hand, when the water content of the rubber composition is too high, the core may become too soft, which may make it difficult to obtain a suitable core initial velocity.

It is also possible to include water directly in the rubber composition. The following methods (i) to (iii) may be employed to include water:

(i) applying steam or ultrasonically applying water in the form of a mist to some or all of the rubber composition (compounded material);
(ii) immersing some or all of the rubber composition in water;
(iii) letting some or all of the rubber composition stand for a fixed period of time in a high-humidity environment in a place where the humidity can be controlled, such as a constant humidity chamber.

As used herein, "high-humidity environment" is not particularly limited, so long as it is an environment capable of moistening the rubber composition, although a humidity of from 40 to 100% is preferred.

Alternatively, the water may be worked into a jelly state and added to the above rubber composition. Or a material obtained by first supporting water on a filler, unvulcanized rubber, rubber powder or the like may be added to the rubber composition. In such a form, the workability is better than when water is directly added to the composition, enabling the golf ball production efficiency to be enhanced. The type of material in which a given amount of water has been Included, although not particularly limited, is exemplified by fillers, unvulcanized rubbers and rubber powders in which sufficient water has been included. The use of a material which undergoes no loss of durability or resilience is especially preferred. The water content of the above material is preferably at least 5 wt %, and more preferably at least 10 wt %. The upper limit is preferably not more than 99 wt %, and more preferably not more than 95 wt %.

A metal monocarboxylate may be used instead of the water. Metal monocarboxylates, in which the carboxylic acid is presumably coordination-bonded to the metal, are distinct from metal dicarboxylates such as zinc diacrylate of the formula $(CH_2{=}CHCOO)_2Zn$. A metal monocarboxylate introduces water into the rubber composition by way of a dehydration/condensation reaction, and thus provides an effect similar to that of water. Moreover, because a metal monocarboxylate can be added to the rubber composition as a powder, the operations can be simplified and uniform dispersion within the rubber composition is easy. In order to carry out the above reaction effectively, a monosalt is required. The amount of metal monocarboxylate included per 100 parts by weight of the base rubber is preferably at least 1 part by weight, and more preferably at least 3 parts by weight. The upper limit in the amount of metal monocarboxylate included is preferably not more than 60 parts by weight, and more preferably not more than 50 parts by weight. When the amount of metal monocarboxylate included is too small, it may be difficult to obtain a suitable crosslink density and tan δ, as a result of which a sufficient golf ball spin rate-lowering effect may not be achievable. On the other hand, when too much is included, the core may become too hard, as a result of which it may be difficult for the ball to retain a suitable feel at impact.

The carboxylic acid used may be, for example, acrylic acid, methacrylic acid, maleic acid, fumaric acid or stearic acid. Examples of the substituting metal include sodium, potassium, lithium, zinc, copper, magnesium, calcium, cobalt, nickel and lead, although the use of zinc is preferred. Illustrative examples of the metal monocarboxylate include zinc monoacrylate and zinc monomethacrylate, with the use of zinc monoacrylate being especially preferred.

The rubber composition containing the various above Ingredients is prepared by mixture using a typical mixing apparatus, such as a Banbury mixer or a roll mill. When this rubber composition is used to mold the core, molding may be carried out by compression molding or injection molding using a specific mold for molding cores. The resulting molded body is then heated and cured under temperature conditions sufficient for the organic peroxide and co-cross-linking agent included in the rubber composition to act, thereby giving a core having a specific hardness profile. The vulcanization conditions in this case, while not subject to any particular limitation, are generally set to a temperature of from about 100 to about 200° C., and especially 130 to 170° C., and a time of from 10 to 40 minutes, and especially 12 to 20 minutes.

The core diameter, although not particularly limited, may be set to from 35 to 39 mm. In this case, the lower limit is preferably at least 36.0 mm, more preferably at least 36.5 mm, and even more preferably at least 36.7 mm. The upper limit may be set to preferably not more than 38.0 mm, more preferably not more than 37.5 mm, and even more preferably not more than 37.3 mm.

The core has a center hardness (Cc), expressed in terms of JIS-C hardness, which, although not particularly limited, may be set to preferably at least 51, more preferably at least 54, and even more preferably at least 57. The upper limit may be set to preferably not more than 67, more preferably not more than 64, and even more preferably not more than 61. When this value is too large, the spin rate may rise excessively, as a result of which a good distance may not be obtained, and the feel at impact may be too hard. On the other hand, when this value is too small, the rebound may be too low, as a result of which a good distance may not be obtained, or the feel at impact may be too soft, in addition to which the durability to cracking on repeated impact may worsen.

The core has a surface hardness (Cs), expressed in terms of JIS-C hardness, which, although not particularly limited, may be set to preferably at least 75, more preferably at least 80, and even more preferably at least 85. The upper limit may be set to preferably not more than 100, more preferably not more than 95, and even more preferably not more than 92. The core surface hardness (Cs), expressed in terms of Shore D hardness, although not particularly limited, may be set to preferably at least 49, more preferably at least 53, and even more preferably at least 57. The upper limit may be set to preferably not more than 68, more preferably not more than 64, and even more preferably not more than 62. When this value is too large, the spin rate may rise excessively, as a result of which a good distance may not be obtained, or the feel at impact may be too hard. On the other hand, when this value is too small, the rebound may be too low, as a result of which a good distance may not be obtained, or the feel at impact may be too soft and the durability to cracking under repeated impact may worsen.

As used herein, the center hardness (Cc) refers to the hardness measured at the center of the cross-section obtained by cutting the core in half through the center, and the surface hardness (Cs) refers to the hardness measured at the spherical surface of the core.

The hardness difference between the core center and the core surface is optimized so as to make the hardness difference between the inside and outside of the core large. The core surface hardness (Cs)−core center hardness (Cc) value, expressed in terms of JIS-C hardness, may be set to at least 20, preferably at least 23, and more preferably at least 26. The upper limit may be set to preferably not more than 36, more preferably not more than 33, and even more preferably not more than 30. When the hardness difference is too large, the durability to cracking on repeated impact may worsen, or the feel on full shots may be hard. On the other hand, when the hardness difference is too small, the spin rate on full shots may rise excessively, as a result of which a good distance may not be obtained, or the feel at impact may become too hard.

The core has a cross-sectional hardness at a position midway between the center and surface of the core (Cm), expressed in terms of JIS-C hardness, which, although not particularly limited, may be set to preferably at least 57, more preferably at least 60, and even more preferably at least 63. The upper limit may be set to preferably not more than 74, more preferably not more than 71, and even more preferably not more than 68. When this value is too large, the spin rate may rise excessively, as a result of which a good distance may not be achieved, or the feel of the ball may be too hard. On the other hand, when the value is too small, the rebound may be too low, as a result of which a good distance may not be achieved, the feel may be too soft, or the durability to cracking on repeated impact may worsen.

The core has a hardness at a position 5 mm from the core center (C5), expressed in terms of JIS-C hardness, which, although not particularly limited, may be set to preferably at least 55, more preferably at least 58, and even more preferably at least 61. The upper limit may be set to preferably not more than 71, more preferably not more than 68, and even more preferably not more than 65. When this value is too large, the spin rate may rise excessively, as a result of which a good distance may not be achieved, or the feel at impact may be too hard. On the other hand, when the value is too small, the rebound may be too low, as a result of which a good distance may not be achieved, the feel may be too soft, or the durability to cracking on repeated impact may worsen.

The relationship between the hardness at a position 5 mm from the core center (C5) and the core center hardness (Cc) is optimized in a specific range so that the hardness at the center portion of the core is relatively flat or so as to make the hardness gradient near this portion relatively gradual. That is, the value C5−Cc expressed in terms of JIS-C hardness, although not particularly limited, is preferably at least 1, more preferably at least 2, and even more preferably at least 3. The upper limit is preferably not more than 7, more preferably not more than 6, and even more preferably not more than 5. When this value is too large, the spin rate may rise excessively, as a result of which a good distance may not be achieved, or the feel at impact may be too hard. On the other hand, when this value is too small, the rebound may be too low, as a result of which a good distance may not be obtained, the feel at impact may be too soft, or the durability to cracking on repeated impact may worsen.

The value obtained by subtracting of the core center hardness (Cc) from the hardness (Cm) at a position midway between the core surface and core center is optimized in a specific range so as to make the hardness gradient at the core interior relatively gradual. That is, the Cm−Cc value expressed in terms of JIS-C hardness, although not particularly limited, may be set to preferably at least 1, more preferably at least 3, and even more preferably at least 5. The upper limit may be set to preferably 10 or less, more preferably 8 or less, and even more preferably 7 or less. When this value is too large, the spin rate may rise excessively, as a result of which a good distance may not be achieved, or the feel at impact may be too hard. On the other hand, when this value is too small, the rebound may be too low, as a result of which a good distance may not be achieved, the feel at impact may be too soft, or the durability to cracking on repeated impact may worsen.

The value obtained by subtracting the core hardness at a position midway between the core surface and core center (Cm) from the core surface hardness (Cs), that is, the value Cs−Cm, expressed in terms of JIS-C hardness, although not particularly limited, may be set to preferably at least 13, more preferably at least 17, and even more preferably at least 20. The upper limit may be set to preferably 32 or less, more preferably 29 or less, and even more preferably 26 or less. When this value is too large, the feel at impact may be too hard, or the durability to cracking under repeated impact may worsen. On the other hand, when this value is too small, the spin rate may be too high, as a result of which a good distance may not be obtained, or the feel at impact may be too soft.

Although the gradient at the core interior is relatively gradual in degree, in order to make the overall gradient large, the [core surface hardness (Cs)−core center hardness (Cc)]/[hardness at a position midway between the core surface and core center (Cm)−core center hardness (Cc)] value is optimized in a specific range. That is, this value, expressed in terms of JIS-C hardness, although not particularly limited, may be set to preferably at least 2, more preferably at least 3, and even more preferably at least 4. The upper limit may be set to preferably 8 or less, more preferably 7 or less, and even more preferably 6 or less. When this value is too large, the durability to cracking on repeated impact may worsen, or the rebound may be low, as a result of which a good distance may not be obtained. On the other hand, when this value is too small, the spin rate may rise, as a result of which a good distance may not be obtained, or the feel at impact may be too hard.

The [core surface hardness (Cs)−core center hardness (Cc)]/[hardness at a position 5 mm from core center (C5)−core center hardness (Cc)] value is optimized in a specific range in order to make the gradient at the core exterior larger in degree than the gradient at the core interior. That is, this value, expressed in terms of JIS-C hardness, although not particularly limited, may be set to preferably at least 4, more preferably at least 5, and even more preferably at least 6. The upper limit may be set to preferably 10 or less, more preferably 9 or less, and even more preferably 8 or less. When this value is too large, the durability to cracking on repeated impact may worsen, or the rebound may be low, as a result of which a good distance may not be obtained. On the other hand, when this value is too small, the spin rate may rise, as a result of which a good distance may not be obtained, or the feel at impact may be too hard.

The core has a deflection when compressed under a final load of 1,275 N (130 kgf) from an initial load of 98 N (10 kgf) which, although not particularly limited, is preferably at least 2.5 mm, more preferably at least 3.0 mm, and even more preferably at least 3.2 mm. The upper limit may be set to preferably 7.0 mm or less, more preferably 6.0 mm or less, and even more preferably 4.5 mm or less. When the core is harder than this range (i.e., when the deflection is too small), the spin rate may rise excessively, as a result of which the ball may not achieve a good distance, or the feel at impact may be too hard. On the other hand, when the core is softer than this range (i.e., when the deflection is too large), the rebound may be too low, as a result of which the ball may not achieve a good distance, the feel at impact may be too soft, or the durability to cracking under repeated impact may worsen.

Next, the envelope layer is described. The envelope layer material is not particularly limited, although various types of thermoplastic resin materials may be preferably used. In particular, in order to be able to fully achieve the desired effects of the invention, it is preferable to use a high-resilience resin material, especially a highly neutralized resin material, as the envelope layer material. As the highly neutralized resin material, preferred use can be made of one formed primarily of a resin composition containing the following components A to D:

100 parts by weight of a resin component composed of, in admixture, (A) a base resin of (a-1) an olefin-unsaturated carboxylic acid random copolymer and/or a metal ion neutralization product of an olefin-unsaturated carboxylic acid random copolymer mixed with (a-2) an olefin-unsaturated carboxylic acid-unsaturated carboxylic acid ester random copolymer and/or a metal ion neutralization product of an olefin-unsaturated carboxylic acid-unsaturated carboxylic acid ester random copolymer in a weight ratio between 100:0 and 0:100, and (B) a non-ionomeric thermoplastic elastomer in a weight ratio between 100:0 and 50:50;

(C) from 5 to 120 parts by weight of a fatty acid and/or fatty acid derivative having a molecular weight of from 228 to 1,500; and (D) from 0.1 to 17 parts by weight of a basic inorganic metal compound capable of neutralizing un-neutralized acid groups in components A and C.

Components A to D in the resin material for an intermediate layer described in, for example, JP-A 2011-120898 may be advantageously used as above components A to D.

The above resin composition may be obtained by mixing components A to D under applied heat. For example, the resin composition can be obtained by using a known mixer such as a kneading type twin-screw extruder, a Banbury mixer or a kneader to intimately mix the resin composition under heating at a temperature of 150 to 250° C. Alternatively, direct use can be made of a commercial product, specific examples of which include those having the trade names HPF 1000, HPF 2000 and HPF AD1027, as well as the experimental material HPF SEP1264-3 (all from E.I. DuPont de Nemours & Co.).

The envelope layer has a material hardness, expressed in terms of Shore D hardness, which, although not particularly limited, is preferably at least 40, more preferably at least 45, and even more preferably at least 47, with the upper limit being preferably 63 or less, more preferably 60 or less, and even more preferably 58 or less. At an envelope layer material hardness lower than this range, the ball may be too receptive to spin on full shots, as a result of which an increased distance may not be achieved. On the other hand, at a material hardness higher than this range, the durability to cracking on repeated impact may worsen, or the feel at impact may be too hard.

The sphere obtained by encasing the core with the envelope layer (referred to below as the "envelope layer-encased sphere") has a surface hardness, expressed in terms of Shore D hardness, which is preferably at least 46, more preferably at least 51, and even more preferably at least 53, with the upper limit being preferably 69 or less, more preferably 66 or less, and even more preferably 64 or less. At a surface hardness lower than this range, the ball may be too receptive to spin on full shots, as a result of which an increased distance may not be obtained. On the other hand, at a surface hardness higher than this range, the durability to cracking on repeated impact may worsen, or the feel at impact may be too hard.

The envelope layer has a thickness which, although not particularly limited, is preferably at least 0.5 mm, more preferably at least 0.7 mm, and even more preferably at least 0.9 mm, with the upper limit being preferably 2.5 mm or less, more preferably 1.7 mm or less, and even more preferably 1.2 mm or less. Outside of this range, the spin rate-lowering effect on shots with a driver (W#1) may be inadequate, as a result of which an increased distance may not be obtained.

Next, the resin material used in the intermediate layer is described. The intermediate layer material is not particularly limited, although various types of thermoplastic resin materials may be preferably used. In particular, in order to be able to fully achieve the desired effects of the invention, it is preferable to use a high-resilience resin material as the intermediate layer material. For example, the use of an ionomer resin material is preferred. Illustrative examples of ionomer resin materials include sodium-neutralized ionomer resins available under the trade names Himilan 1605, Himilan 1601 and Surlyn 8120, and zinc-neutralized ionomer resins such as Himilan 1557 and Himilan 1706. These may be used singly, or two or more may be used in combination.

It is especially preferable for the intermediate layer material to be in a form that is composed primarily of, in admixture, a zinc-neutralized ionomer resin and a sodium-neutralized ionomer resin. The compounding ratio thereof, expressed as the weight ratio "zinc-neutralized ionomer resin/sodium-neutralized ionomer resin," is typically from 25/75 to 75/25, preferably from 35/65 to 65/35, and more preferably from 45/55 to 55/45. If the zinc-neutralized ionomer and the sodium-neutralized ionomer are not included within this range, the resilience may be too low, as a result of which the intended distance may not be obtained, or the durability to cracking on repeated impact at normal temperatures may worsen and the durability to cracking at low (subzero) temperatures may also worsen.

The construction of the intermediate layer is not limited to one layer; where necessary, two or more intermediate layers of the same or different types may be formed within the above-indicated range. By forming a plurality of intermediate layers, the spin rate on shots with a driver can be reduced, enabling the distance traveled by the ball to be increased even further. Also, the spin properties and feel at the time of impact can be further improved.

The intermediate layer has a material hardness, expressed in terms of Shore D hardness, which, although not particularly limited, is preferably at least 50, more preferably at least 55, and even more preferably at least 60, with the upper limit being preferably 70 or less, more preferably 68 or less, and even more preferably 65 or less. At a material hardness lower than this range, the ball may be too receptive to spin on full shots, as a result of which an increased distance may not be achieved. On the other hand, at a material hardness higher than this range, the durability to cracking on repeated impact may worsen, or the feel at impact on shots with a putter or on short approaches may be too hard. Also, it is desirable for the material hardness of the intermediate layer to be higher than the material hardness of the subsequently described cover (outermost layer).

The sphere obtained by encasing the envelope layer with the intermediate layer (referred to below as the "intermediate layer-encased sphere") has a surface hardness, expressed in terms of Shore D hardness, which is preferably at least 56, more preferably at least 61, and even more preferably at least 66, with the upper limit being preferably 76 or less, more preferably 74 or less, and even more preferably 71 or less. At a surface hardness lower than this range, the ball may be too receptive to spin on full shots, as a result of which an increased distance may not be obtained. On the other hand, at a surface hardness higher than this range, the durability to cracking on repeated impact may worsen, or the feel at impact on shots with a putter or on short approaches may be too hard.

The intermediate layer has a thickness which, although not particularly limited, is preferably at least 0.5 mm, more preferably at least 0.7 mm, and even more preferably at least 0.9 mm, with the upper limit being preferably 2.0 mm or less, more preferably 1.5 mm or less, and even more preferably 1.2 mm or less. Outside of this range, the spin rate-lowering effect on shots with a W#1 may be inadequate, as a result of which an increased distance may not be obtained. Also, at a thickness that is smaller than this range, the durability to cracking on repeated impact and the durability at low temperatures may worsen.

It is advantageous to abrade the surface of the intermediate layer in order to increase adhesion with the polyurethane that is preferably used in the subsequently described cover (outermost layer). In addition, it is desirable to apply a primer (adhesive) to the surface of the intermediate layer following such abrasion treatment or to add an adhesion reinforcing agent to the intermediate layer material.

Next, the cover, which corresponds to the outermost layer of the ball, is described. The material of the cover (outermost layer) is not particularly limited, although preferred use can be made of various types of thermoplastic resin materials. For reasons having to do with controllability and scuff resistance, it is preferable to use a urethane resin as the cover material of the invention. In particular, from the standpoint of the mass productivity of manufactured golf balls, it is preferable to use a cover material composed primarily of a thermoplastic polyurethane, with formation more preferably being carried out using a resin blend composed primarily of (P) a thermoplastic polyurethane and (Q) a polyisocyanate compound.

In the thermoplastic polyurethane composition containing above components P and Q, to improve the ball properties even further, a necessary and sufficient amount of unreacted isocyanate groups should be present in the cover resin material. Specifically, it is recommended that the combined weight of above components P and Q be at least 60%, and more preferably at least 70%, of the weight of the overall cover layer. Components P and Q are described below in detail.

The thermoplastic polyurethane (P) has a structure which includes soft segments composed of a polymeric polyol (polymeric glycol) that is a long-chain polyol, and hard segments composed of a chain extender and a polyisocyanate compound. Here, the long-chain polyol serving as a starting material may be any that has hitherto been used in the art relating to thermoplastic polyurethanes, and is not particularly limited. Illustrative examples include polyester polyols, polyether polyols, polycarbonate polyols, polyester polycarbonate polyols, polyolefin-based polyols, conjugated diene polymer-based polyols, castor oil-based polyols, silicone-based polyols and vinyl polymer-based polyols. These long-chain polyols may be used singly, or two or more may be used in combination. Of these, in terms of being able to synthesize a thermoplastic polyurethane having a high rebound resilience and excellent low-temperature properties, a polyether polyol is preferred.

Any chain extender that has hitherto been employed in the art relating to thermoplastic polyurethanes may be advantageously used as the chain extender. For example, low-molecular-weight compounds with a molecular weight of 400 or less which have on the molecule two or more active hydrogen atoms capable of reacting with isocyanate groups are preferred. Illustrative examples of the chain extender include, but are not limited to, 1,4-butylene glycol, 1,2-ethylene glycol, 1,3-butanediol, 1,6-hexanediol and 2,2-dimethyl-1,3-propanediol. Of these, an aliphatic diol having 2 to 12 carbons is preferred, and 1,4-butylene glycol is more preferred, as the chain extender.

Any polyisocyanate compound hitherto employed in the art relating to thermoplastic polyurethanes may be advantageously used without particular limitation as the polyisocyanate compound. For example, use may be made of one, two or more selected from the group consisting of 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethyihexamethylene diisocyanate and dimer acid diisocyanate. However, depending on the type of isocyanate, the crosslinking reaction during injection molding may be difficult to control. In the practice of the invention, to provide a balance between stability at the time of production and the properties that are manifested, it is most preferable to use the following aromatic diisocyanate: 4,4'-diphenylmethane diisocyanate.

Commercially available products may be used as the thermoplastic polyurethane serving as component P. Illustrative examples include Pandex T-8295, T-8290, T-8283 and T-8260 (all from DIC Bayer Polymer, Ltd.).

Although not an essential ingredient, (R) a thermoplastic elastomer other than the above thermoplastic polyurethane may be included as an additional component together with above components P and Q. By including this component R in the above resin blend, a further improvement in the flowability of the resin blend can be achieved and the properties required of a golf ball cover material, such as resilience and scuff resistance, can be enhanced.

The relative proportions of above components P, Q and R are not particularly limited. However, to fully elicit the desirable effects of the invention, the weight ratio P:Q:R is preferably from 100:2:50 to 100:50:0, and more preferably from 100:2:50 to 100:30:8.

In addition to the ingredients making up the thermoplastic polyurethane, various additives may be optionally included in the above resin blend. For example, pigments, dispersants, antioxidants, light stabilizers, ultraviolet absorbers and internal mold lubricants may be suitably included.

The cover (outermost layer) has a material hardness, expressed in terms of Shore D hardness, which, although not particularly limited, is preferably at least 30, more preferably at least 35, and even more preferably at least 40, with the upper limit being preferably 60 or less, more preferably 57 or less, and even more preferably 54 or less.

The cover (outermost layer)-encased sphere, i.e., the ball, has a surface hardness, expressed in terms of Shore D hardness, which is preferably at least 37, more preferably at least 46, and even more preferably at least 55, with the upper limit being preferably 65 or less, more preferably 62 or less, and even more preferably 60 or less. At a ball surface hardness lower than this range, the spin rate on full shots rises, which may result in poor distance. On the other hand, at a ball surface hardness higher than this range, the ball may have poor spin receptivity on approach shots and may therefore lack sufficient controllability even for professional golfers and skilled amateurs, or may have an excessively poor scuff resistance.

The cover (outermost layer) has a thickness which, although not particularly limited, is preferably at least 0.3 mm, more preferably at least 0.5 mm, and even more preferably at least 0.7 mm, with the upper limit being preferably 1.5 mm or less, more preferably 1.2 mm or less, and even more preferably 1.0 mm or less. At a cover (outermost layer) thickness larger than this range, the rebound on W#1 shots may be inadequate and the spin rate may be too high, as a result of which a good distance may not be obtained. On the other hand, at a cover thickness that is too small, the scuff resistance may be poor and the controllability may be inadequate even for professional golfers and skilled amateurs.

The manufacture of multi-piece solid golf balls in which the above-described core, envelope layer, intermediate layer and cover (outermost layer) are formed as successive layers may be carried out by a customary method such as a known injection-molding process. For example, a multi-piece golf ball may be obtained by placing a molded and vulcanized product composed primarily of a rubber material as the core in a given injection mold and injecting an envelope layer material over the core to give a first intermediate sphere, then placing this sphere in another injection mold and injecting an intermediate layer material over the sphere to give a second intermediate sphere, and subsequently placing the second intermediate sphere in yet another injection mold and injection-molding a cover (outermost layer) material over the latter sphere. Alternatively, the envelope layer, intermediate layer and cover (outermost layer) may be successively formed over the core and the respective intermediate spheres by a method that involves encasing the core and each of the intermediate spheres in turn with these respective layers. For example, in each step, a particular intermediate sphere may be enclosed within two half-cups that have been pre-molded into hemispherical shapes from the material that is to form the subsequent layer, after which molding is carried out under applied heat and pressure.

The golf ball of the invention preferably satisfies also the following conditions.

(1) Relationship between Surface Hardness of Ball and Surface Hardness of Intermediate Layer-Encased Sphere In order for the ball to have a structure in which the cover is hard on the inside and soft on the outside (that is, the intermediate layer is harder than the cover) and the intermediate layer is hard, it is critical for the surface hardnesses of the ball and the intermediate layer-encased sphere to satisfy the relationship:

surface hardness of ball<surface hardness of intermediate layer-encased sphere.

That is, the value obtained by subtracting the surface hardness of the intermediate layer-encased sphere from the surface hardness of the ball, expressed in terms of Shore D hardness, is preferably −20 or above, and more preferably −15 or above, with the upper limit being preferably 0 or below, more preferably −3 or below, and even more preferably −5 or below. When this value is too large, the intended spin rate on approach shots cannot be obtained, as a result of which the controllability may be inadequate. On the other hand, when this value is too small, the ball becomes too receptive to spin on full shots, as a result of which the intended distance may not be obtained.

(2) Relationship Between Thicknesses of Intermediate Layer and Cover

The relative thicknesses of the intermediate layer and the cover are set in a specific range. That is, the value obtained by subtracting the intermediate layer thickness from the cover thickness is preferably −1.0 mm or above, more preferably −0.5 mm or above, and even more preferably −0.2 mm or above, with the upper limit being preferably −0.05 mm or below, and more preferably −0.1 mm or below. When this value is too large, the ball becomes too receptive to spin on full shots, as a result of which the intended distance may not be obtained. On the other hand, when this value is too small, the intended spin rate on approach shots cannot be obtained, as a result of which the controllability may be inadequate.

(3) Relationship Between Initial Velocities of Ball and Core

In order for the ball interior to have a relatively high resilience, the relationship between the initial velocities of the ball and the core is preferably adjusted within a specific range. That is, the value obtained by subtracting the core initial velocity from the ball initial velocity is preferably −1.0 m/s or above, more preferably −0.7 m/s or above, and even more preferably −0.5 m/s or above, with the upper limit being preferably 0.2 m/s or below, more preferably 0 m/s or below, and even more preferably −0.2 m/s or below. When this value falls outside of the above range, the initial velocity on full shots and the spin rate cannot both be achieved at a high level, as a result of which the intended distance may not be obtained. Measurement of the initial velocities of the respective spheres is carried out with the measurement apparatus and under the measurement conditions described below in the Examples section.

(4) Relationship Between Deflections of Core and Ball Under Specific Loading

Letting E be the deflection of the core when compressed under a final load of 1,275 N (130 kgf) from an initial load of 98 N (10 kgf) and B be the deflection of the ball when compressed under a final load of 1,275 N (130 kgf) from an initial load of 98 N (10 kgf), the value E−B is preferably at least 0.5 mm, more preferably at least 0.7 mm, and even more preferably at least 0.9 mm, with the upper limit being preferably 1.5 mm or less, more preferably 1.3 mm or less, and even more preferably 1.0 mm or less. When this value is too large, the durability to cracking on repeated impact may worsen, or the initial velocity of the ball on full shots may decrease, as a result of which the intended distance may not be obtained. On the other hand, when this value is too small, the spin rate on full shots may become too high, as a result of which the intended distance may not be obtained.

(5) Relationship Between Initial Velocities of Ball and Envelope Layer-Encased Sphere The relationship between the initial velocities of the ball and the envelope layer-encased sphere is preferably adjusted within a specific range in order to give the interior of the ball a relatively high resilience. That is, the relationship between the initial velocity of the ball and the initial velocity of the envelope layer-encased sphere is such that the value obtained by subtracting the initial velocity of the envelope layer-encased sphere from the initial velocity of the ball is preferably −1.0 m/s or above, more preferably −0.7 m/s or above, and more preferably −0.5 m/s or above, with the upper limit being preferably 0.2 m/s or below, more preferably 0 m/s or below, and even more preferably −0.2 m/s or below. When this value falls outside of the above range, the initial velocity on full shots and the spin rate cannot both be achieved at a high level, as a result of which the intended distance may not be obtained. Measurement of the initial velocities of the respective spheres is carried out with the measurement apparatus and under the measurement conditions described below in the Examples section.

(6) Relationship between Initial Velocities of Ball and Intermediate Layer-Encased Sphere The relationship between the initial velocities of the ball and the intermediate layer-encased sphere is preferably adjusted within a specific range in order to give the interior of the ball a relatively high resilience. That is, the relationship between the initial velocity of the ball and the initial velocity of the intermediate layer-encased sphere is such that the value obtained by subtracting the initial velocity of the intermediate layer-encased sphere from the initial velocity of the ball is preferably −2.0 m/s or above, more preferably −1.5 m/s or above, and even more preferably −1.0 m/s or above, with the upper limit being preferably −0.2 m/s or below, more preferably −0.4 m/s or below, and even more preferably −0.6 m/s or below. When this value falls outside of the above range, the distance on shots with a driver (W#1) and the controllability on approach shots cannot both be achieved at a high level. Measurement of the initial velocities of the respective spheres is carried out with the measurement apparatus and under the measurement conditions described below in the Examples section.

(7) Relationship between Surface Hardnesses of Intermediate Layer-Encased Sphere and Envelope Layer-Encased Sphere The intermediate layer is made relatively hard and the relationship between the surface hardnesses of the intermediate layer-encased sphere and the envelope layer-encased sphere is optimized within a specific range. That is, the value obtained by subtracting the surface hardness of the envelope layer-encased sphere from the surface hardness of the intermediate layer-encased sphere, expressed in terms of Shore D hardness, is preferably at least 4, more preferably at least 7, and even more preferably at least 10, with the upper limit being preferably 21 or less, more preferably 18 or less, and even more preferably 15 or less. When this value is too large, the durability to cracking under repeated impact may worsen, or the feel at impact may become too hard. On the other hand, when this value is too small, the spin rate on full shots may be too high, as a result of which the intended distance may not be obtained.

(8) Relationship between Initial Velocities of Intermediate Layer-Encased Sphere and Envelope Layer-Encased Sphere The intermediate layer resin material is given a good resilience and the relationship between the initial velocities of the intermediate layer-encased sphere and the envelope layer-encased sphere is optimized within a specific range. That is, the value obtained by subtracting the initial velocity of the envelope layer-encased sphere from the initial velocity of the intermediate layer-encased sphere is set to preferably −0.6 m/s or above, more preferably −0.3 m/s or above, and even more preferably 0 m/s or above, with the upper limit being preferably 1.0 m/s or below, more preferably 0.7 m/s or below, and even more preferably 0.4 m/s or below. When this value falls outside of the above range, the initial velocity and spin rate on full shots cannot both be achieved at a high level, as a result of which the intended distance may not be obtained. Measurement of the initial velocities of the respective spheres is carried out with the measurement apparatus and under the measurement conditions described below in the Examples section.

(9) Relationship between Initial Velocities of Envelope Layer-Encased Sphere and Core The envelope layer resin material is given a good resilience and the relationship between the initial velocities of the envelope layer-encased sphere and the core is optimized within a specific range. That is, the value obtained by subtracting the initial velocity of the core from the initial velocity of the envelope layer-encased sphere is set to preferably −0.5 m/s or above, more preferably −0.2 m/s or above, and even more preferably 0.1 m/s or above, with the upper limit being preferably 1.0 m/s or below, more preferably 0.7 m/s or below, and even more preferably 0.4 m/s or below. When this value falls outside of the above range, the initial velocity and spin rate on full shots cannot both be achieved at a high level, as a result of which the intended distance may not be obtained. Measurement of the initial velocities of the respective spheres is carried out with the measurement apparatus and under the measurement conditions described below in the Examples section.

(10) Relationship Between Deflections of Core and Envelope Layer-Encased Sphere Under Specific Loading The relationship between the deflections of the core and the envelope layer-encased sphere under specific loading are optimized within a specific range. That is, letting E be the deflection of the core when compressed under a final load of 1,275 N (130 kgf) from an initial load of 98 N (10 kgf) and T be the deflection of the envelope layer-encased sphere when compressed under a final load of 1,275 N (130 kgf) from an initial load of 98 N (10 kgf), the value E−T is preferably at least 0 mm, more preferably at least 0.2 mm, and even more preferably at least 0.4 mm, with the upper limit being preferably 1.0 mm or less, more preferably 0.7 mm or less, and even more preferably 0.5 mm or less. When this value is too large, the feel at impact may be too hard, or the initial velocity on full shots may be low, as a result of which the intended distance may not be achieved. On the other hand, when this value is too small, the spin rate on full shots may become high, as a result of which the intended distance may not be achieved.

(11) Relationship Between Surface Hardnesses of Envelope Layer-Encased Sphere and Ball The envelope layer is made relatively hard and the relationship between the surface hardnesses of the envelope layer-encased sphere and the ball is optimized within a specific range. That is, the value obtained by subtracting the surface hardness of the ball from the surface hardness of the envelope layer-encased sphere, expressed in terms of Shore D hardness, is preferably −15 or above, more preferably −10 or above, and even more preferably −5 or above, with the upper limit being preferably 10 or below, more preferably 5 or below, and even more preferably −1 or below. When this value is too large, the feel at impact may become too hard, or the initial velocity on full shots may be low, as a result of which the intended distance may not be obtained. On the other hand, when this value is too small, the spin rate on full shots may be too high, as a result of which the intended distance may not be obtained.

(12) Relationship Between Surface Hardnesses of Core and Ball

The relationship between the surface hardnesses of the core and the ball is optimized in a specific range in order to achieve a proper feel on full shots and in the short game. That is, the value obtained by subtracting the surface hardness of the ball from the surface hardness of the core, expressed in terms of Shore D hardness, is preferably −3 or above, more preferably −2.5 or above, and even more preferably −2 or above, with the upper limit being preferably 3 or below, more preferably 2 or below, and even more preferably 1 or below. When this value is too large, the feel on full shots may become too hard or the spin may rise, as a result of which the intended distance may not be obtained. On the other hand, when this value is too small, the intended spin may not be obtained in the short game, resulting in poor controllability, or the feel in the short game may be hard.

Numerous dimples may be formed on the surface of the cover (outermost layer). The number of dimples arranged on the cover surface, although not particularly limited, is preferably at least 280, more preferably at least 300, and even more preferably at least 320, with the upper limit being preferably not more than 360, more preferably not more than 350, and even more preferably not more than 340. If the number of dimples is larger than this range, the ball trajectory becomes lower, as a result of which the distance may decrease. On the other hand, if the number of dimples is too small, the ball trajectory becomes higher, as a result of which a good distance may not be achieved.

The dimple shapes that are used may be of one type or a combination of two or more types selected from among circular shapes, various polygonal shapes, dewdrop shapes and oval shapes. For example, when circular dimples are used, the dimple diameter may be set to at least about 2.5 mm and up to about 6.5 mm, and the dimple depth may be set to at least 0.08 mm and up to about 0.30 mm.

In order to be able to fully manifest aerodynamic properties, it is desirable for the dimples to have a surface coverage ratio on the spherical surface of the golf ball, i.e., the ratio SR of the sum of the individual dimple surface areas, each defined by the flat plane circumscribed by the edge of a dimple, with respect to the spherical surface area of the ball were it to have no dimples thereon, which is set to at least 60% and up to 90%. Also, in order to optimize the ball trajectory, it is desirable for the value $V_0$, defined as the spatial volume of the individual dimples below the flat plane circumscribed by the dimple edge, divided by the volume of the cylinder whose base is the flat plane and whose height is the maximum depth of the dimple from the base, to be set to at least 0.35 and up to 0.80. Moreover, it is preferable for the ratio VR of the sum of the spatial volumes of the individual dimples, each formed below the flat plane circumscribed by the edge of a dimple, with respect to the volume of the ball sphere were the ball surface to have no dimples thereon, to be set to at least 0.6% and up to 1.0%. Outside of the above ranges in these respective values, the resulting trajectory may not enable a good distance to be obtained, and so the ball may fail to travel a fully satisfactory distance.

The multi-piece solid golf ball of the invention can be made to conform to the Rules of Golf for play. Specifically, the inventive ball may be formed to a diameter which is such that the ball does not pass through a ring having an inner diameter of 42.672 mm and is not more than 42.80 mm, and to a weight which is preferably from 45.0 to 45.93 g.

EXAMPLES

The following Examples and Comparative Examples are provided to illustrate the invention, and are not intended to limit the scope thereof.

Examples 1 and 2, Comparative Examples 1 to 7

Solid cores for the respective Examples of the invention and Comparative Examples were produced by preparing the rubber compositions shown in Table 1 below, then molding and vulcanizing the compositions under the vulcanization conditions shown in the same table.

TABLE 1

| Core formulations | Example | | Comparative Example | | | | | | |
|---|---|---|---|---|---|---|---|---|---|
| (pbw) | 1 | 2 | 1 | 2 | 3 | 4 | 5 | 6 | 7 |
| Polybutadiene A | 80 | 80 | 80 | 80 | 80 | 80 | 20 | | |
| Polybutadiene B | 20 | 20 | 20 | 20 | 20 | 20 | 80 | | 20 |
| Polybutadiene C | | | | | | | | 100 | 80 |
| Zinc acrylate | 44.1 | 38.6 | 44.1 | 44.1 | 44.1 | 44.1 | 31.5 | 36.5 | 36.6 |
| Peroxide (1) | 1.0 | 1.0 | 1.0 | 1.0 | 1.0 | 1.0 | | | 1.05 |
| Peroxide (2) | | | | | | | 2.5 | 3.0 | |
| Sulfur | | | | | | | | 0.12 | 0.09 |
| Water | 1 | 1 | 1 | 1 | 1 | 1 | | | |
| Antioxidant | 0.1 | 0.1 | 0.1 | 0.1 | 0.1 | 0.1 | 0.1 | 0.1 | 0.2 |
| Barium sulfate | 13.7 | 16.0 | 13.7 | 13.7 | 13.7 | 13.7 | 18.5 | | |
| Zinc stearate | | | | | | | | 5 | 5 |
| Zinc oxide | 4 | 4 | 4 | 4 | 4 | 4 | 4 | 19.5 | 20.6 |
| Zinc salt of pentachlorothiophenol | 0.5 | 0.5 | 0.5 | 0.5 | 0.5 | 0.5 | 0.3 | 0.6 | 0.4 |
| Vulcanization conditions Temp. (° C.) | 157 | 157 | 157 | 157 | 157 | 157 | 157 | 157 | 155 |
| Time (min) | 15 | 15 | 15 | 15 | 15 | 15 | 15 | 15 | 21 |

Details on the ingredients shown in Table 1 are given below.

Polybutadiene A: Available under the trade name "BR 01" from JSR Corporation

Polybutadiene B: Available under the trade name "BR 51" from JSR Corporation

Polybutadiene C: Available under the trade name "BR 730" from JSR Corporation

Zinc acrylate: Available from Nippon Shokubai Co., Ltd.

Peroxide (1): Dicumyl peroxide, available under the trade name "Percumyl D" from NOF Corporation Peroxide (2): 1,1-Bis(t-butylperoxy)-3,3,5-trimethyl-cyclohexane, available under the trade name "Perhexa 3M-40" from NOF Corporation Antioxidant: 2,2'-Methylenebis(4-methyl-6-t-butylphenol), available under the trade name "Nocrac NS-6" from Ouchi Shinko Chemical Industry Co., Ltd.

Barium sulfate: Available under the trade name "Barico #300" from Hakusui Tech

Zinc oxide: Available under the trade name "Zinc Oxide Grade 3" from Sakai Chemical Co., Ltd.

Zinc stearate: Available under the trade name "Zinc Stearate G" from NOF Corporation Sulfur: Available under the trade name "Sulfax-5" from Tsurumi Chemical Industry Co., Ltd.

Zinc Salt of Pentachlorothiophenol: Available from ZHEJIANG CHO & FU CHEMICAL

Formation of Envelope Layer, Intermediate Layer and Cover (Outermost Layer)

Figure 2:
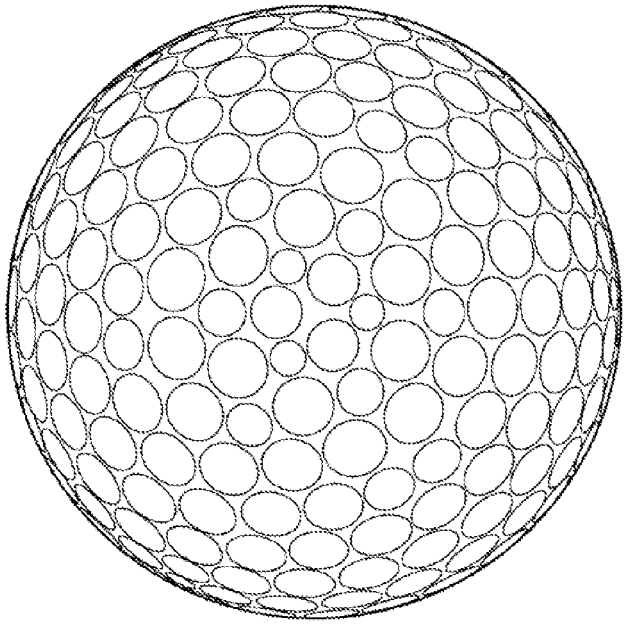
FIG. 2 is a top view of a golf ball showing the dimple pattern used in the examples of the invention.

The envelope layer material formulated as shown in Table 2 was injection-molded over the core obtained as described above to form an envelope layer, thereby giving an envelope layer-encased sphere. The intermediate layer material formulated as shown in Table 2 was then injection-molded over the resulting envelope layer-encased sphere to form an intermediate layer, thereby giving an intermediate layer-encased sphere. Next, the cover (outermost layer) material formulated as shown in Table 2 was injection-molded over the resulting intermediate layer-encased sphere to form a cover, thereby producing a multi-piece solid golf ball provided with, over the core: an envelope layer, an intermediate layer and a cover. The dimples shown in FIG. 2 were formed at this time on the cover surface. Details on the dimples are given in Table 3.

TABLE 2

| Resin materials (pbw) | I | II | III | IV | V | VI | VII |
|---|---|---|---|---|---|---|---|
| T-8295 | | | | | 100 | | |
| T-8290 | | | 75 | | | | |
| T-8283 | | | 25 | | | | |
| HPF 1000 | 100 | | | | | | |
| Himilan 1706 | | 35 | | | | | |
| Himilan 1557 | | 15 | | | | | |
| Himilan 1605 | | 50 | | | | | 100 |
| Surlyn 8120 | | | | | | 74 | |
| AN 4319 | | | | 20 | | | |
| AN 4221C | | | | 80 | | | |
| Dynaron 6100P | | | | | | 26 | |
| Hytrel 4001 | | | 11 | | 11 | | |
| Titanium oxide | | | 3.9 | | 3.9 | | |
| Polyethylene wax | | | 1.2 | | 1.2 | | |
| Isocyanate compound | | | 7.5 | | 7.5 | | |
| Trimethylolpropane | | 1.1 | | | | | 1.1 |
| Behenic acid | | | | | | 20 | |
| Magnesium stearate | | | | 60 | | | |
| Calcium stearate | | | | | | 0.15 | |
| Zinc stearate | | | | | | 0.15 | |
| Calcium hydroxide | | | | 1.5 | | 2.3 | |
| Magnesium oxide | | | | 1 | | | |
| Polytail H | | | | 8 | | | |

Details on the materials shown in Table 2 are as follows.

T-8295, T-8290, T-8283: MDI-PTMG type thermoplastic polyurethanes available from DIC Bayer Polymer under the trademark Pandex.

HPF 1000: Available from E.I. DuPont de Nemours & Co. as "HPF™ 1000"

Himilan: Ionomers available from DuPont-Mitsui Polychemicals Co., Ltd.

Surlyn: An ionomer available from E.I. DuPont de Nemours & Co.

AN 4319, AN 4221C: Available under the trade name "Nucrel" from DuPont-Mitsui Polychemicals Co., Ltd.

Dynaron 6100P: A thermoplastic block copolymer available from JSR Corporation

Hytrel 4001: A polyester elastomer available from DuPont-Toray Co., Ltd.

Titanium oxide: Tipaque R550, available from Ishihara Sangyo Kaisha, Ltd.

Polyethylene wax: Available as "Sanwax 161P" from Sanyo Chemical industries, Ltd.

Isocyanate compound: 4,4'-Diphenylmethane diisocyanate

Trimethylolpropane: Available from Mitsubishi Gas Chemical Co., Ltd.

Behenic acid: Available as "NAA-222S" from NOF Corporation

Magnesium stearate: Available as "Magnesium Stearate G" from NOF Corporation

Calcium stearate: Available as "Calcium Stearate G" from NOF Corporation

Zinc stearate: Available as "Zinc Stearate G" from NOF Corporation

Calcium hydroxide: Available as "CLS-B" from Shiraishi. Calcium Kaisha, Ltd.

Magnesium oxide: Available as "Kyowamag MF 150" from Kyowa Chemical Industry Co., Ltd.

Polytail H: Available from Mitsubishi Chemical Corporation

TABLE 3

| No. | Number of dimples | Diameter (mm) | Depth (mm) | $V_0$ | SR (%) | VR (%) |
|---|---|---|---|---|---|---|
| 1 | 12 | 4.6 | 0.15 | 0.47 | 81 | 0.783 |
| 2 | 234 | 4.4 | 0.15 | 0.47 | | |
| 3 | 60 | 3.8 | 0.14 | 0.47 | | |
| 4 | 6 | 3.5 | 0.13 | 0.46 | | |
| 5 | 6 | 3.4 | 0.13 | 0.46 | | |
| 6 | 12 | 2.6 | 0.10 | 0.46 | | |
| Total | 330 | | | | | |

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

SR: Sum of individual dimple surface areas, each defined by the flat plane circumscribed by the edge of a dimple, as a percentage of the surface area of a hypothetical sphere were the ball to have no dimples on the surface thereof.

VR: Sum of spatial volumes of individual dimples formed below flat plane circumscribed by the edge of a dimple, as a percentage of the volume of a hypothetical sphere were the ball to have no dimples on the surface thereof.

The following measurements and evaluations were carried out on the golf balls obtained as described above. The results are shown in Table 4.

Diameters of Core, Envelope Layer-Encased Sphere and Intermediate Layer-Encased Sphere The diameters at five random places on the surface of a core, an envelope layer-encased sphere or an intermediate layer-encased sphere were measured at a temperature of 23.9±1° C. and, using the average of these measurements as the measured value for a single core, envelope layer-encased sphere or intermediate layer-encased sphere, the average diameter for five measured cores, envelope layer-encased spheres or intermediate layer-encased spheres was determined.

Diameter of Ball (Cover-Encased Sphere)

The diameters at five random dimple-free places (lands) on the surface of a ball were measured at a temperature of 23.9±1° C. and, using the average of these measurements as the measured value for a single ball, the average diameter for five measured balls was determined.

Deflections of Core, Envelope Layer-Encased Sphere, Intermediate Layer-Encased Sphere and Ball The core, envelope layer-encased sphere, intermediate layer-encased sphere or ball was placed on a hard plate and the amount of deflection when compressed under a final load of 1,275 N (130 kgf) from an initial load of 98 N (10 kgf) was measured for each. The amount of deflection here refers to the measured value obtained after holding the test specimen isothermally at 23.9° C.

Center Hardness (JIS-C Hardness) of Core (Cc)

The hardness at the center of the cross-section obtained by cutting the core in half through the center was measured. Measurement was carried out with the spring-type durometer (JIS-C model) specified in JIS K 6301-1975.

Surface Hardness (JIS-C Hardness) of Core (Cs)

Measurements were taken by pressing the durometer Indenter perpendicularly against the surface of the spherical core. The JIS-C hardness was measured with the spring-type durometer (JIS-C model) specified in JIS K 6301-1975. In addition, the Shore D hardnesses were measured with a type D durometer in accordance with ASTM D2240-95.

Cross-Sectional Hardnesses (JIS-C Hardnesses) at Specific Positions of Core (1) To determine the cross-sectional hardness at a position 5 mm from the core center (C5), a core was cut in half through the center and the hardness at a position 5 mm from the center of the resulting cross-section was measured with the spring-type durometer (JIS-C model) specified in JIS K 6301-1975.

(2) To determine the cross-sectional hardness at a position midway between the core surface and center, a core was cut in half through the center and the hardness at a position midway between the center and surface of the resulting cross-section was measured with the above durometer (JIS-C model).

Surface Hardnesses (Shore D Hardnesses) of Envelope Layer-Encased Sphere, Intermediate Layer-Encased Sphere and Ball (Cover)

Measurements were taken by pressing the durometer indenter perpendicularly against the surface of the envelope layer-encased sphere, the intermediate layer-encased sphere or the ball (cover). The surface hardness of the ball (cover) is the measured value obtained at dimple-free places (lands) on the ball surface. The Shore D hardnesses were measured with a type D durometer in accordance with ASTM D2240-95.

Material Hardnesses (Shore D Hardnesses) of Envelope Layer, Intermediate Layer and Cover The resin materials for, respectively, the envelope layer, the intermediate layer and the cover were formed into sheets having a thickness of 2 mm and left to stand for at least two weeks, following which the Shore D hardnesses were measured in accordance with ASTM D2240-95.

Initial Velocities of Various Layer-Encased Spheres

The initial velocities were measured using an initial velocity measuring apparatus of the same type as the USGA drum rotation-type initial velocity instrument approved by the R&A. The cores, envelope layer-encased spheres, intermediate layer-encased spheres and balls (cover-encased spheres) (referred to below as "spherical test specimens") were held isothermally in a 23.9±1° C. environment for at least 3 hours, and then tested in a chamber at a room temperature of 23.9±2° C. Each spherical test specimen was hit using a 250-pound (113.4 kg) head (striking mass) at an impact velocity of 143.8 ft/s (43.83 m/s). One dozen spherical test specimens were each hit four times. The time taken for the test specimen to traverse a distance of 6.28 ft (1.91 m) was measured and used to compute the initial velocity (m/s). This cycle was carried out over a period of about 15 minutes.

TABLE 4

| | | Example | | Comparative Example | | | | | | |
|---|---|---|---|---|---|---|---|---|---|---|
| | | 1 | 2 | 1 | 2 | 3 | 4 | 5 | 6 | 7 |
| Construction | | 4-piece | 4-piece | 4-piece | 4-piece | 4-piece | 4-piece | 4-piece | 4-piece | 4-piece |
| Core | Diameter (mm) | 37.0 | 37.1 | 37.0 | 37.0 | 37.0 | 37.0 | 37.1 | 37.1 | 37.0 |
| | Weight (g) | 31.5 | 31.6 | 31.5 | 31.5 | 31.5 | 31.5 | 31.5 | 31.6 | 31.5 |
| | Deflection (mm) | 3.3 | 3.8 | 3.3 | 3.3 | 3.3 | 3.3 | 3.3 | 3.4 | 3.3 |
| | Initial velocity (m/s) | 77.5 | 77.6 | 77.5 | 77.5 | 77.5 | 77.5 | 77.5 | 77.5 | 77.3 |
| Hardness profile of core (JIS-C) | Surface hardness (Cs) | 89.5 | 86.1 | 89.5 | 89.5 | 89.5 | 89.5 | 87.8 | 87.2 | 90.4 |
| | Hardness at position midway between surface and center (Cm) | 66.9 | 63.5 | 66.9 | 66.9 | 66.9 | 66.9 | 74.4 | 72.6 | 66.0 |
| | Hardness at position 5 mm from center (C5) | 64.2 | 61.8 | 64.2 | 64.2 | 64.2 | 64.2 | 73.5 | 69.1 | 60.9 |
| | Center hardness (Cc) | 60.0 | 58.2 | 60.0 | 60.0 | 60.0 | 60.0 | 67.5 | 61.8 | 61.4 |
| | Surface hardness − Center hardness (Cs − Cc) | 29.5 | 27.9 | 29.5 | 29.5 | 29.5 | 29.5 | 20.3 | 25.4 | 29.0 |
| | Cm − Cc | 6.9 | 5.3 | 6.9 | 6.9 | 6.9 | 6.9 | 6.8 | 10.8 | 4.6 |
| | C5 − Cc | 4.2 | 3.6 | 4.2 | 4.2 | 4.2 | 4.2 | 6.0 | 7.3 | — |
| | Cs − Cm | 22.6 | 22.6 | 22.6 | 22.6 | 22.6 | 22.6 | 13.5 | 14.6 | 24.4 |
| | (Cs − Cc)/(Cm − Cc) | 4.3 | 5.2 | 4.3 | 4.3 | 4.3 | 4.3 | 3.0 | 2.4 | 6.3 |
| | (Cs − Cc)/(C5 − Cc) | 7.1 | 7.7 | 7.1 | 7.1 | 7.1 | 7.1 | 3.4 | 3.5 | — |
| Surface hardness of core (Ds), Shore D | | 60 | 57 | 60 | 60 | 60 | 60 | 59 | 58 | 61 |

TABLE 4-continued

| | | Example | | Comparative Example | | | | | | |
|---|---|---|---|---|---|---|---|---|---|---|
| | | 1 | 2 | 1 | 2 | 3 | 4 | 5 | 6 | 7 |
| Envelope layer | Material (type) | I | I | I | I | VI | I | I | I | I |
| | Thickness (mm) | 1.0 | 1.0 | 1.0 | 1.0 | 1.0 | 1.0 | 1.0 | 1.0 | 1.0 |
| | Specific gravity | 0.95 | 0.94 | 0.95 | 0.95 | 0.95 | 0.95 | 0.95 | 0.95 | 0.95 |
| | Sheet (material hardness), Shore D | 50 | 50 | 50 | 50 | 50 | 50 | 50 | 50 | 50 |
| Envelope layer-encased sphere | Diameter (mm) | 39.1 | 39.1 | 39.1 | 39.1 | 39.1 | 39.1 | 39.1 | 39.1 | 39.1 |
| | Weight (g) | 35.9 | 35.9 | 35.9 | 35.9 | 35.9 | 35.9 | 36.0 | 35.9 | 36.0 |
| | Deflection (mm) | 2.9 | 3.4 | 2.9 | 2.9 | 2.9 | 2.9 | 3.4 | 2.9 | 2.9 |
| | Initial velocity (m/s) | 77.9 | 77.8 | 77.9 | 77.9 | 77.4 | 77.9 | 77.9 | 77.9 | 77.7 |
| | Surface hardness (Es), Shore D | 56 | 56 | 56 | 56 | 56 | 56 | 56 | 56 | 56 |
| Envelope layer surface hardness (Es) − Core surface hardness (Ds) | | −4 | −1 | −4 | −4 | −4 | −4 | −3 | −2 | −5 |
| Initial velocity of envelope layer-encased sphere − Core initial velocity (m/s) | | 0.3 | 0.2 | 0.3 | 0.3 | −0.1 | 0.3 | 0.4 | 0.4 | 0.4 |
| Core deflection − Deflection of envelope layer-encased sphere (mm) | | 0.5 | 0.4 | 0.5 | 0.5 | 0.4 | 0.5 | −0.1 | 0.5 | 0.4 |
| Intermediate layer | Material (type) | II | II | IV | II | II | VII | II | II | II |
| | Thickness (mm) | 1.0 | 1.0 | 1.0 | 0.6 | 1.0 | 1.0 | 1.0 | 1.0 | 1.0 |
| | Sheet (material hardness), Shore D | 62 | 62 | 55 | 62 | 62 | 61 | 62 | 62 | 62 |
| Intermediate layer-encased sphere | Diameter (mm) | 41.0 | 41.0 | 41.0 | 40.3 | 41.0 | 41.0 | 41.0 | 41.0 | 41.0 |
| | Weight (g) | 40.6 | 40.6 | 40.6 | 38.8 | 40.6 | 40.6 | 40.6 | 40.6 | 40.7 |
| | Deflection (mm) | 2.5 | 2.9 | 2.3 | 2.6 | 2.5 | 2.5 | 2.5 | 2.5 | 2.5 |
| | Initial velocity (ms) | 78.1 | 78.0 | 77.9 | 78.0 | 77.6 | 77.8 | 78.1 | 78.1 | 77.9 |
| | Surface hardness (Ms), Shore D | 69 | 69 | 62 | 69 | 69 | 68 | 68 | 69 | 69 |
| Intermediate layer surface hardness (Ms) − Envelope layer surface hardness (Es) | | 13 | 13 | 6 | 13 | 13 | 12 | 12 | 13 | 13 |
| Initial velocity of intermediate layer-encased sphere − Initial velocity of envelope layer-encased sphere (m/s) | | 0.2 | 0.2 | 0.0 | 0.1 | 0.2 | 0.0 | 0.2 | 0.2 | 0.2 |
| Cover | Material (type) | III | III | V | III | III | III | III | III | III |
| | Thickness (mm) | 0.8 | 0.8 | 0.8 | 1.2 | 0.8 | 0.8 | 0.8 | 0.8 | 0.8 |
| | Specific gravity | 1.11 | 1.11 | 1.11 | 1.11 | 1.11 | 1.11 | 1.11 | 1.11 | 1.11 |
| | Sheet (material hardness), Shore D | 47 | 47 | 57 | 47 | 47 | 47 | 47 | 47 | 47 |
| Ball | Diameter (mm) | 42.7 | 42.7 | 42.7 | 42.7 | 42.7 | 42.7 | 42.7 | 42.7 | 42.7 |
| | Weight (g) | 45.4 | 45.4 | 45.5 | 45.8 | 45.5 | 45.5 | 45.4 | 45.4 | 45.5 |
| | Deflection (mm) | 2.4 | 2.8 | 2.0 | 2.5 | 2.4 | 2.4 | 2.4 | 2.4 | 2.4 |
| | Initial velocity (m/s) | 77.3 | 77.2 | 77.1 | 76.8 | 76.8 | 77.0 | 77.2 | 77.3 | 77.1 |
| | Surface hardness (Bs), Shore D | 59 | 59 | 62 | 56 | 59 | 58 | 59 | 59 | 59 |
| Envelope layer surface hardness − Ball surface hardness (Shore D) | | −3 | −3 | −6 | 0 | −3 | −2 | −3 | −3 | −3 |
| Ball surface hardness (Bs) − Intermediate layer surface hardness (Ms) | | −10 | −10 | 0 | −13 | −10 | −10 | −9 | −10 | −10 |
| Cover thickness − Intermediate layer thickness (mm) | | −0.1 | −0.2 | −0.1 | 0.6 | −0.2 | −0.1 | −0.1 | −0.1 | −0.1 |
| Ball initial velocity − Core initial velocity (m/s) | | −0.3 | −0.4 | −0.5 | −0.7 | −0.7 | −0.5 | −0.3 | −0.3 | −0.2 |
| Core surface hardness − Ball surface hardness (Shore D) | | 1 | −2 | −2 | 4 | 1 | 2 | 0 | −1 | 2 |
| Core deflection − Ball deflection (mm) | | 0.9 | 1.0 | 1.3 | 0.8 | 0.9 | 0.9 | 0.9 | 1.0 | 0.9 |
| Ball initial velocity − Initial velocity of envelope layer-encased sphere (m/s) | | −0.3 | −0.4 | −0.5 | −0.7 | −0.7 | −0.5 | −0.3 | −0.3 | −0.2 |
| Ball Initial velocity − Initial velocity of intermediate layer-encased sphere (m/s) | | −0.8 | −0.8 | −0.8 | −1.2 | −0.8 | −0.8 | −0.9 | −0.8 | −0.8 |

The flight performance on shots with a driver (W#1), spin performance on approach shots, feel, and scuff resistance of the golf balls obtained in each of the Examples of the invention and the Comparative Examples were evaluated according to the following criteria. The results are shown in Table 5.

Flight Performance on Shots with a Driver

A driver (W#1) was mounted on a golf swing robot, the distance traveled by the ball when struck at a head speed (HS) of 50 m/s was measured, and the flight performance was rated according to the criteria shown below. The club used was a TourStage X-Drive 709 D430 driver (2013 model; loft angle, 8.5°) manufactured by Bridgestone Sports Co., Ltd. The above head speed corresponds to what is generally the average head speed of professional golfers and skilled amateur golfers.

Rating Criteria:

Good: Total distance was 265.0 m or more

NG: Total distance was less than 265.0 m

Spin Performance on Approach Shots

A sand wedge was mounted on a golf swing robot, and the spin rate of the ball when hit at a head speed (HS) of 35 m/s was rated according to the following criteria.

Rating Criteria:

Good: Spin rate was 6,000 rpm or more

NG: Spin rate was less than 6,000 rpm

Feel

Sensory evaluations were carried out when the balls were hit with a driver (W#1) by golfers having head speeds of 45 to 55 m/s. The feel of the ball was rated according to the following criteria.

Rating Criteria:

Good: Six or more out of ten golfers rated the feel as good

NG: Five or fewer out of ten golfers rated the feel as good

Here, a "good feel" refers to a feel at impact that is appropriately soft.

Scuff Resistance

A non-plated pitching sand wedge was set in a swing robot and the ball was hit once at a head speed of 40 m/s, following which the surface state of the ball was visually examined and rated as follows.

Good: The ball was judged to be capable of use again.

NG: The ball was judged to be no longer capable of use.

TABLE 5

| | | | Example | | Comparative Example | | | | | | |
|---|---|---|---|---|---|---|---|---|---|---|---|
| | | | 1 | 2 | 1 | 2 | 3 | 4 | 5 | 6 | 7 |
| Flight performance | W#1 HS, 50 m/s | Spin rate (rpm) | 2,830 | 2,686 | 2,920 | 2,988 | 2,945 | 2,914 | 2,889 | 2,887 | 2,915 |
| | | Total distance (m) | 265.8 | 266.8 | 267.1 | 263.6 | 263.3 | 262.8 | 264.5 | 264.6 | 264.1 |
| | | Rating | good | good | good | NG | NG | NG | NG | NG | NG |
| Performance on approach shots | | Spin rate (rpm) | good | good | NG | good | good | good | good | good | good |
| Feel | | Rating | good | good | good | good | good | good | good | good | good |
| Scuff resistance | | Rating | good | good | NG | good | good | good | good | good | good |

In Comparative Example 1, the ball surface hardness was higher than the intermediate layer surface hardness. As a result, the intended spin rate on approach shots was not achieved.

In Comparative Example 2, the cover (outermost layer) was thicker than the intermediate layer. As a result, the spin rate on full shots rose, and so the intended distance was not achieved.

In Comparative Example 3, the initial velocity of the envelope layer-encased sphere was lower than the initial velocity of the core. As a result, the spin rate on full shots was high, and so the intended distance was not achieved.

In Comparative Example 4, the initial velocity of the intermediate layer-encased sphere was higher than the initial velocity of the envelope layer-encased sphere. As a result, the spin rate on fully shots was high, and so the intended distance was not achieved.

In Comparative Example 5, the value obtained by subtracting the center hardness of the core from the surface hardness of the core, expressed in terms of JIS-C hardness, was less than 22. As a result, the spin rate on full shots was high, and so the intended distance was not achieved.

In Comparative Example 6, the value obtained by subtracting the core center hardness (Cc) from the hardness at a position 5 mm from the core center (C5), expressed in terms of JIS-C hardness, was larger than 7. In addition, the [core surface hardness (Cs)−core center hardness (Cc)]/[hardness at a position midway between the core surface and center (Cm)−core center hardness (Cc)] value, expressed in terms of JIS-C hardness, was smaller than 3. As a result, the spin rate on full shots was high, and so the intended distance was not achieved.

In Comparative Example 7, the hardness at a position 5 mm from the core center (C5) was lower than the core center hardness. As a result, the balance between the initial velocity and the spin rate on actual shots was poor, and so the intended distance was not achieved.

Japanese Patent Application No. 2014-257439 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a core, an envelope layer encasing the core, an intermediate layer encasing the envelope layer, and an outermost layer encasing the intermediate layer, wherein the sphere obtained by peripherally encasing the core with the envelope layer (envelope layer-encased sphere), the sphere obtained by peripherally encasing the envelope layer with the intermediate layer (intermediate layer-encased sphere), and the ball have respective surface hardnesses, expressed in terms of Shore D hardness, which satisfy the relationship ball surface hardness <surface hardness of intermediate layer-encased sphere>surface hardness of envelope layer-encased sphere;

the intermediate layer and the outermost layer have respective thicknesses which satisfy the relationship outermost layer thickness <intermediate layer thickness;

the core, the envelope layer-encased sphere, the intermediate layer-encased sphere and the ball have respective initial velocities which satisfy the relationship ball initial velocity <initial velocity of intermediate layer-encased sphere>initial velocity of envelope layer-encased sphere >core initial velocity; and the core has a hardness profile which, expressed in terms of JIS-C hardness, satisfies the following relationships:

22≤core surface hardness (Cs)−core center hardness (Cc),

7≥[hardness at a position 5 mm from core center (C5)−core center hardness (Cc)]>0, and

[core surface hardness (Cs)−core center hardness (Cc)]/[hardness at a position midway between core surface and core center (Cm)−core center hardness (Cc)]≥3.

2. The golf ball of claim 1, wherein the [hardness at a position midway between core surface and core center (Cm)−core center hardness (Cc)] value, expressed in terms of JIS-C hardness, is 10 or less.

3. The golf ball of claim 1, wherein the [hardness at a position 5 mm from core center (C5)−core center hardness (Cc)] value, expressed in terms of JIS-C hardness, is 5 or less.

4. The golf ball of claim 1, wherein the [core surface hardness (Cs)−core center hardness (Cc)]/[hardness at a position 5 mm from core center (C5)−core center hardness (Cc)] value, expressed in terms of JIS-C hardness, is 4 or more.

5. The golf ball of claim 1, wherein the initial velocity of the intermediate layer-encased sphere is larger than the core initial velocity.

6. The golf ball of claim 1, wherein the (core surface hardness−ball surface hardness) value, expressed in terms of Shore D hardness, is in the range of from −3 to 3.

7. The golf ball of claim 1, wherein the initial velocities of the core, the intermediate layer-encased sphere and the ball satisfy the relationships:

(ball initial velocity−core initial velocity)≥−1.0 m/s; and (ball initial velocity−initial velocity of envelope layer-encased sphere)≥−1.0 m/s.

* * * * *